United States Patent [19]

Gerich

[11] Patent Number: 4,750,646

[45] Date of Patent: Jun. 14, 1988

[54] FEED SYSTEM

[76] Inventor: Horst Gerich, 24034 Welby Way, Canoga Park, Calif. 91307

[21] Appl. No.: 74,333

[22] Filed: Jul. 16, 1987

[51] Int. Cl.[4] ..... B67D 5/06; B67D 5/54

[52] U.S. Cl. ..... 222/166; 222/167; 222/181; 222/185; 222/400.7; 137/212; 414/763

[58] Field of Search ..... 222/1, 181, 185, 399, 222/400.7, 167, 501, 489, 166; 137/588, 212; 414/419, 421, 783, 763

[56] References Cited

U.S. PATENT DOCUMENTS

| | | | |
|---|---|---|---|
| 2,143,823 | 1/1939 | Mason | 137/212 |
| 2,301,416 | 11/1942 | Krug | 137/212 X |
| 2,785,838 | 3/1957 | Mayer, Jr. | 222/402.25 |
| 3,127,073 | 3/1964 | Carleton | 222/400.7 |
| 3,490,483 | 1/1970 | Nicko | 137/212 |
| 3,777,920 | 12/1973 | Wiese | 414/421 |

*Primary Examiner*—Joseph J. Rolla
*Assistant Examiner*—Gregory L. Huson

[57] ABSTRACT

A liquid delivery system, particularly for liquids sensitive to water or in which no bubbles should be included, which permits dispensing the liquid directly from the container in which it was shipped and stored. The delivery system attaches directly to the container and has a breather tube communicating with air head space above the liquid. The breather tube can be opened and closed manually. The breather tube allows air or gas to enter the head space as liquid is dispensed from the container. In operation, the liquid delivery system is attached to the liquid container and the container and system are placed on an inversion device. The container is inverted in use.

3 Claims, 2 Drawing Sheets

FEED SYSTEM

BACKGROUND OF THE INVENTION

This invention relates to a feed system for feeding liquids of various viscosities and it is particularly adapted for high viscosity liquids which have the propensity to entrap bubbles and liquids which are susceptible to oxidation and thereby require an inert storage gas over them or are susceptible to degradation when small amounts of moisture are present and therefore require that the storage gas contacting them be very dry.

Where catalyzed mixtures are used, it has become an increasing problem to exclude bubbles in structural members since they create defects and rejection of the final product. In many applications, the prolonged presence of moisture in the air in contact with the base or catalyst liquid causes it to degrade to the point that a product produced with the liquid does not meet specifications and thus must be rejected. In the glass industry, catalyzed materials are fed to seal glass windows into frames. The inclusion of bubbles or moisture degraded materials cannot be tolerated in applications of this type.

The typical materials which are fed by the present invention are resins and catalyst materials. These materials are typically shipped in various sized drums and containers which have a top opening. The present invention is adapted to fit these top openings. Thus the materials can be fed directly from the containers in which they are shipped and a transfer of the materials to a separate specialized container is not necessary. At the present time the materials are transferred to a "pressure-pot" where the air is removed from the top of the liquid and a pressure piston is placed on the top of the liquid to prevent the inclusion of a deleterious gas or the inclusion of bubbles in the liquid. This present day apparatus is very expensive to use due to the high cost of equipment and is expensive to operate and maintain.

PRIOR ART

Breather tubes for feeding liquid are well known and their normal purpose is to allow the ingress of air above the liquid while the liquid is being dispensed from the bottom of the container. The present invention is directed along these lines but is much more elaborate to prevent the inclusion of bubbles in the liquid and deleterious gases in contact with the liquid.

OBJECTS OF THE INVENTION

Prior to the development of the present invention, it was necessary to remove the catalyst and resin materials from their shipping containers and place them in a specially constructed individual pressurized pots. This pressurized pot is basically a cylindrical container having side walls and a bottom with a movable top piston. After the liquids are placed in this container, the piston is placed on top of the liquid; the gases are withdrawn from between the piston and the liquid and the piston is pressurized to insure that bubbles do not occur in the liquid and that deleterious gases do not enter above the liquid. The liquid is fed from the pressurized pot through a bottom port to its desired end use. The set up time for this arrangement is extensive and expensive.

The present invention eliminates the necessity for a pressure pot and its associated piston pressure mechanism etc. as described above. Instead the present invention consists of a breather tube assembly useable on the shipping container. The breather tube can be opened and closed as described hereinafter. Also the present invention permits a simple introduction of inert gas above the liquid being fed. The gas being introduced above the liquid can be dried through the use of an inline desiccate tube.

The present invention also provides a very simple device for inverting the containers of liquid. It is important that the devices of the present invention be very simple in operation since the technical expertise of the persons using the apparatus is somewhat limited.

It is also important that the present invention be simple in construction not only from a cost standpoint but from a standpoint of cleaning up the apparatus for use in a container of different liquid. Solvents must frequently be used in cleaning up apparatus used in liquids according to the present invention, and such contaminated solvents are very expensive to dispose of due to strict environmental laws. Thus a Minimum amount of solvent should be necessary to clean up a mechanism such as the present invention.

DESCRIPTION OF PREFERRED EMBODIMENT

A container 10 is a typical container or drum in which resins, catalysts and various liquids are shipped. The container 10 has side walls and a top wall 11 having an upstanding spout 12, which is externally threaded to receive a conventional closure cap during shipment.

In using the present invention, it is necessary to invert the container 10 from its upright position with the spout 12 on the top to an upside down position with the spout 12 upside down and in the bottom position. The inverting device is shown in FIGS. 2, 5, 6, and 7 and will be described first hereinafter.

Figure 2:
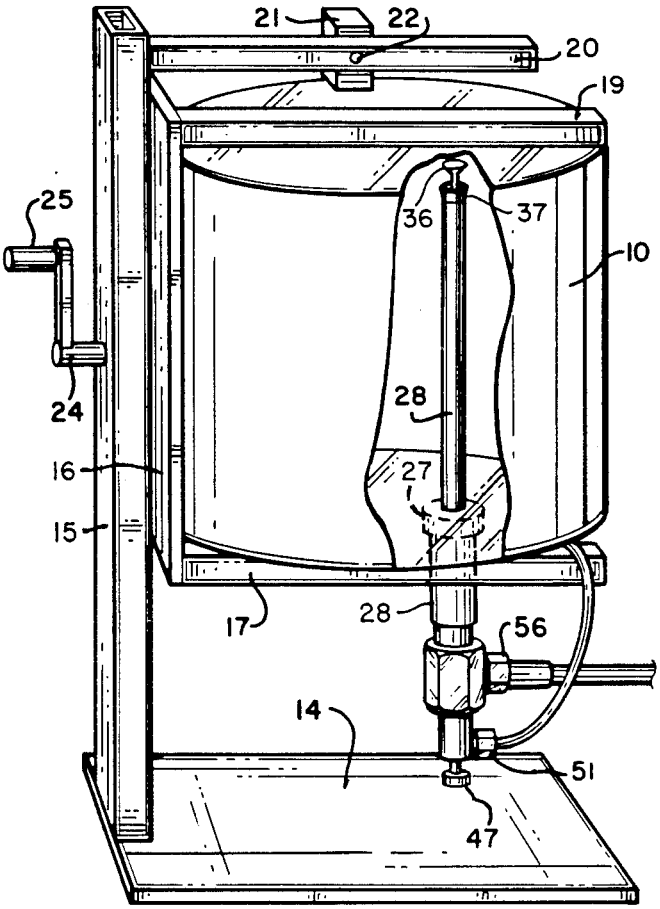
FIG. 2 is a perspective view of an inverted container with the feeding device attached.
Figure 7:
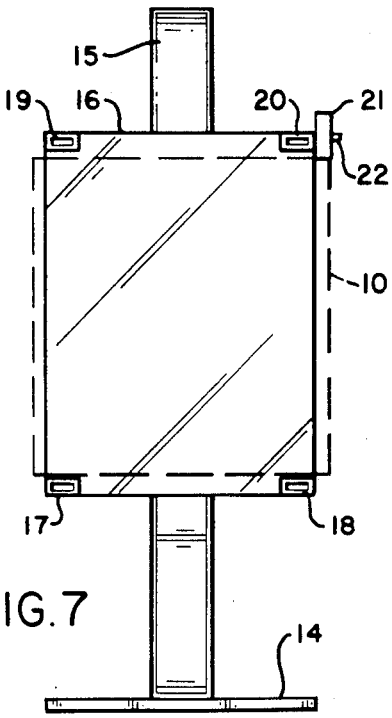
FIG. 7 is an end view of the inverting device.

The inverting device includes a base platform 14 of sufficient dimensions to provide stability to the entire apparatus to be described. A rigid upstanding beam 15 is attached to the base plate. A second rigid plate 16 is in a vertical plane and supported on an axle 24 which is rotatably mounted in plate 15. The plate 16 has two lower arms 17 and 18 integral with it and extending outward in the manner shown in the drawings. The plate 16 also has upper integral arms 19 and 20. The arms 17, 18, 19, and 20 are parallel to each other and extend at right angles to the plate 16. The container 10 is placed on the arms 17, 18, in the manner shown in FIGS. 5, 6, and 7. A locking device consisting of a short piece of metal bar 21 is pivoted on an axle 22 and when swung to the vertical position, as shown in FIGS. 2 and 7, will lock the drum 10 against the bars 17 and 18.

The plate 16 is rigidly mounted on an axle 24 which is rotatably mounted in an opening in the plate 15. A handle 25 is provided to rotate the axle 24. After the container 10 is locked to the bars 17 and 18 by the locking device 21, the handle 25 is rotated thereby inverting the container. The inverted drum is shown in FIG. 2 with the feeding device of the present invention attached thereto. The feeding device is attached to the container prior to inversion of the container.

Figure 1:
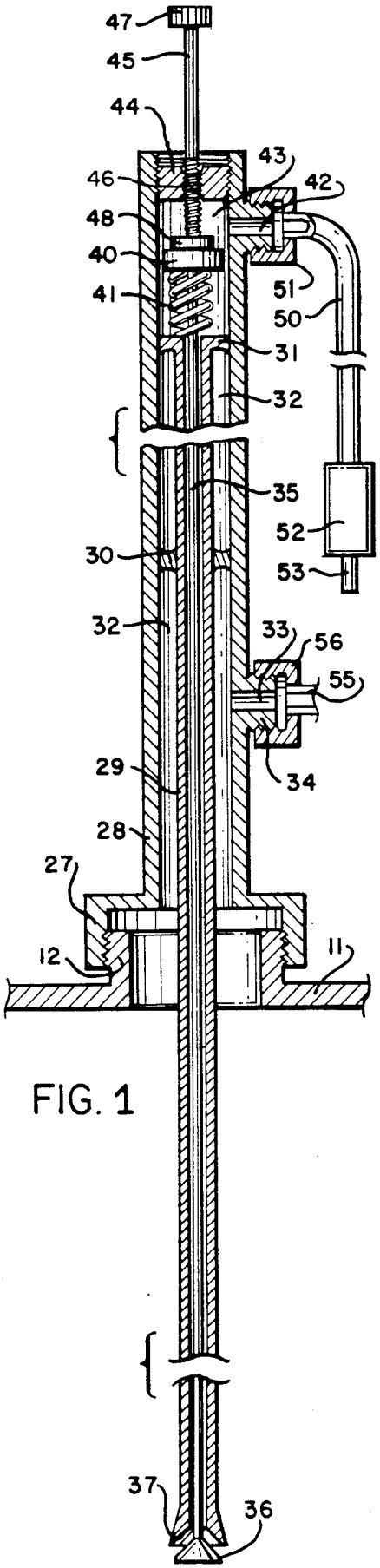
FIG. 1 is a longitudinal cross section through the liquid feeding device of the present invention.

Referring now to FIGS. 1–4, the feeding device according to the present invention includes an internally threaded cap 27 which engages the threaded spout 12 on the container to close spout 12 in the manner shown in FIG. 1. An integral tube 28 extends upwardly from the cap 27. The tube 28 contains an inner tube 29 concentric with it. Spacers 30 maintain the inner tube spaced from the outer tube 28 in the manner shown in FIG. 1. The upper end of tube 29 is closed at 31 thus forming a chamber 32 between the tube 28 and tube 29. The tube 28 has an opening 33 therein which has a threaded nozzle 34. The opening 33 opens into the chamber 32 in the manner shown in FIG. 1.

The tube 29 has a concentric rod 35 extending the length of it. The lower end of the rod, as shown in fig.1, has a stopper configuration 36 which conforms to the receiving configuration 37 of the tube 29.

The upper end of rod 35 threadably receives a locking nut 40 and a spring 41. Spring 41 normally exerts a pressure against the locking nut 40 thereby forcing the rod 35 upwardly as viewed in FIG. 1, and causes the stopper 36 to engage the surface 37 thereby closing the lower end of the tube 29 in the manner shown in FIG. 4.

The tube 28 has a second opening 42 with a threaded outer nozzle. This opening 42 provides entry into a chamber 43 which in turn provides entry into the space between rod 35 and the inner face of tube 29.

A threaded stopper plug 44 threadably closes the upper end of tube 28. A plunger mechanism rod 45 is threadably received at 46 in the plug 44. The upper end of rod 45 has an integral knurled turning knob 47 and the lower end has a stopper plug 48 integral therewith. Thus upon rotation a knurled knob 47 and rod 45, the rod 45 is moved upwardly or downwardly in threads 46. When it is moved downwardly, as shown in FIG. 1, it engages the top of rod 35 thereby pushing it downwardly against the bias of spring 41 and opens the lower end of the tube 29 in the manner shown in FIG. 1. When the knob 47 is rotated in the opposite direction, the rod 45 is elevated to a position shown in FIG. 4, the spring 41 elevates the rod 35 and the lower end of the tube 29 is closed by plug 36 engaging surface 37 (see FIG. 4).

The upper opening 42 communicates with a hose 50 attached to the threaded nozzle by a threaded cap 51 (see FIG. 1). The hose 50 leads to a desiccate container 52 and a tube 53 opens the container to the air or to a pressurized cylinder of gas such as an inert gas, nitrogen. The desiccate container should be sufficiently large to remove moisture from the air if the material in the container 10 is susceptible to damage from moisture. The hose 50 may be connected to any desired gaseous medium, pressurized or unpressurized. Whatever the medium is that is delivered through hose 50, it passes through opening 42 into chamber 43 an thus down the passageway between rod 35 and tube 29 to a lower end, as viewed in FIG. 1 of tube 29 and out the opening between the plug stopper 36 and surface 37.

Figure 3:
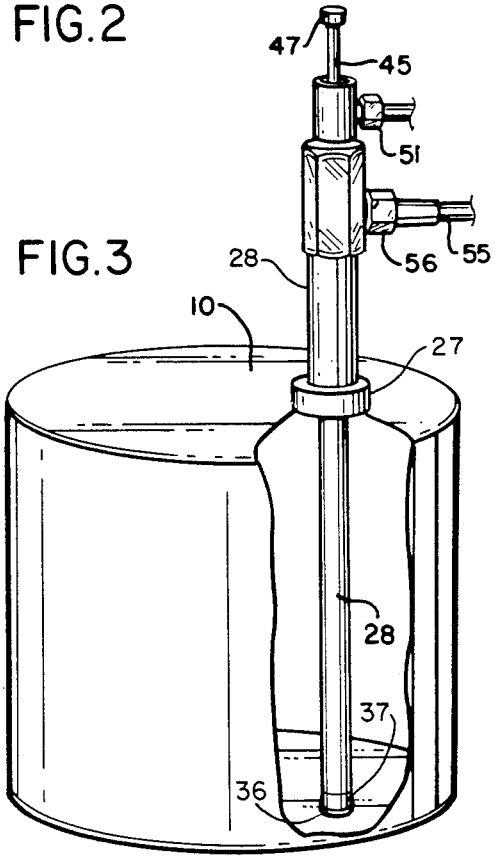
FIG. 3 is an upright view of a container with the feeding device attached.
Figure 4:
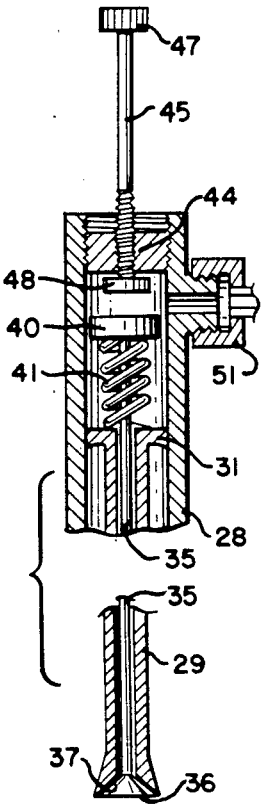
FIG. 4 is a partial cross section similar to FIG. 1 showing the feeding device in a closed position.
Figure 5:
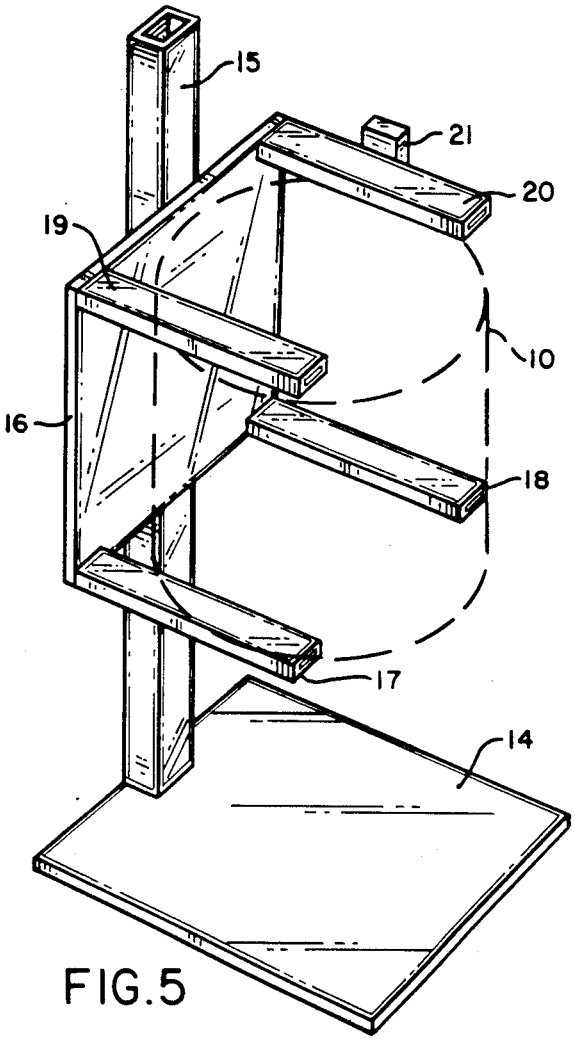
FIG. 5 is a prospective view showing the container inverting device.
Figure 6:
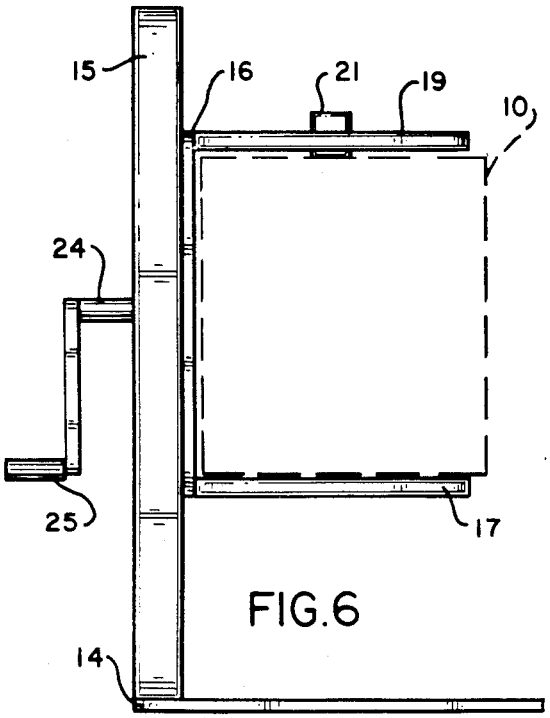
FIG. 6 is a side elevation view of the inverting device.

In operation of the present invention, the device shown in FIG. 1 is attached to the upright container 10 in a manner shown in FIG. 3. The knurled knob 47 is rotated so that the rods 35 and 45 are elevated and the stopper 46 engages surface 37 to close the lower end of the rod. The lower end of the rod is closed prior to inserting the device into the container 10 since it is not desirable to have the liquid in container 10 migrate into the passageway between rod 35 and tube 29. The container is then placed on the inverting device previously described, (see FIG. 5) properly locked in position by locking device 21 and inverted by rotating handle 25 to the position shown in FIG. 2. The plug 36 is then in its uppermost position. Preferably the plug 36 is lightly engaging the top wall of the container in the inverted position if such wall is slightly flexible. In the shipment of liquids in container 10 there is normally a slight gaseous head space in the containers and thus when the containers are inverted the plug 36 and surface 37 are in such head space. The knob 47 is rotated to move the rod 45 into engagement with rod 35 thereby opening the upper end of rod 29 by moving plug 36 away from surface 37. In the normal operation there will be sufficient air head space in the container so that no liquid enters the space between rod 35 and tube 29. Sometimes upward movement of plug 36 causes the drum wall to bulge upwardly.

The opening 33 has had a tube 55 attached to it by a threaded coupling 56 in known manner. The liquid in the inverted drum 10 flows downwardly between tube 29 and tube 28 and out the opening 33 into tube 55. The material in the container 10 is then delivered to the desired end use. It may be either pumped from the container 10 or the pressurized gas introduced through pipe 50 may be used to force the liquid from the drum.

The systems and devices according to present invention are preferrably fabricated from steel but it may be necessary to fabricate them from other metals and alloys to prevent corrosion of the materials due to the nature of the liquids being processed.

While I have described the present embodiment of my invention, while it may be otherwise embodiment of the scope of the following claims

I claim:

1. An apparatus for feeding a bubble-free liquid from a container to a desired end use, comprising:

(a) a container having an opening therein, said container having a liquid therein and gaseous head space above the liquid, (b) a breather and delivery system positionable partly within the container, (c) a closure mechanism forming part of the system and closing the opening in the container, said closure mechanism being on the bottom side of the container, (d) said system including a pair of concentric tubes spaced from each other, the outermost tube being integral with the closure mechanism; the innermost tube being fixed within the outermost tube to provide a liquid flow space therebetween, (e) a rigid rod extending the axial length of and being concentric in the innermost tube; the innermost tube extending from outside the closure mechanism of the container to the gaseous head space above the liquid within the container;

(f) the end of said rod and said innermost tube, located inside the container, having a mating configuration whereby axial movement of the rod relative to said innermost tube end causes the tube end to open for passing gas and to close to prevent the passage of gas;

(g) the innermost tube and the rod being spaced from each other to form a gas passageway therebetween, said gas passageway opening into a gas chamber within the outermost tube at a location outside the container; a gas opening in the outermost tube permitting ingress of gas from outside the chamber into the chamber, (h) a mechanism integral with the outermost tube to move said rod axially of said tubes thereby opening and closing the end of said innermost tube; the last mentioned tube end being open to permit gas flow from exterior of the container, through said gas chamber and said gas passageway into said head space above the liquid in the container;

(i) a second opening in said outermost tube, which permits egress from said liquid flow space between tubes;

(j) said liquid flow space between the tubes opening into the interior of the container, so that liquid in the container flows from the container, through said flow space and out said second opening to a use point, when said rod has been moved to open the end of the innermost tube in said head space above the liquid in the container.

2. An apparatus according to claim 1 including a spring mounted circumferentially around said rod and normally biasing said rod to close the end of the innermost tube, and a movable member engagable against said rod to axially move the rod against the spring pressure to open the end of the innermost tube.

3. An apparatus according to claim 1 including a pivoting unit having (i) arms engagable with said container to rigidly hold the container, (ii) a plate to which the arms are fastened, (iii) means supporting the plate and pivoting said arms and container so that the container is moved from upright to inverted position.

* * * * *